US009201350B2

(12) United States Patent
Shimizu

(10) Patent No.: US 9,201,350 B2
(45) Date of Patent: Dec. 1, 2015

(54) IMAGE FORMING APPARATUS WITH INITIALIZATION MECHANISM

(71) Applicant: FUJI XEROX CO., LTD., Tokyo (JP)

(72) Inventor: Kenji Shimizu, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/194,115

(22) Filed: Feb. 28, 2014

(65) Prior Publication Data

US 2015/0055980 A1 Feb. 26, 2015

(30) Foreign Application Priority Data

Aug. 21, 2013 (JP) ..... 2013-171215

(51) Int. Cl.
*G03G 15/16* (2006.01)
*G03G 15/01* (2006.01)

(52) U.S. Cl.
CPC ..... *G03G 15/161* (2013.01); *G03G 15/0136* (2013.01); *G03G 15/1615* (2013.01); *G03G 2215/0193* (2013.01)

(58) Field of Classification Search
CPC ..... G03G 15/0136; G03G 15/0189; G03G 15/1615; G03G 2215/00143; G03G 2215/0122; G03G 2215/0125; G03G 2215/0193
USPC ..... 399/66, 298, 302, 308
See application file for complete search history.

(56) References Cited

U.S. PATENT DOCUMENTS

| | | | | |
|---|---|---|---|---|
| 8,867,961 | B2 * | 10/2014 | Nakazato | 399/165 |
| 2009/0169274 | A1 * | 7/2009 | Suzuki et al. | 399/302 |
| 2009/0180805 | A1 * | 7/2009 | Nakura et al. | 399/165 |
| 2012/0321328 | A1 | 12/2012 | Nakazato | |

FOREIGN PATENT DOCUMENTS

| | | | |
|---|---|---|---|
| JP | 2009145765 | A * | 7/2009 |
| JP | A-2010-139955 | | 6/2010 |
| JP | A-2013-3381 | | 1/2013 |

* cited by examiner

*Primary Examiner* — Robert Beatty
(74) *Attorney, Agent, or Firm* — Oliff PLC

(57) ABSTRACT

Provided is an image forming apparatus including plural image holding members that have toner images formed on respective surfaces thereof, image forming sections that form the toner images on the plural image holding members, respectively, a belt member that has an endless belt shape, plural transfer members each of which nips the belt member between the transfer member and a corresponding image holding member, a moving mechanism that individually moves the plural transfer members between a first place and a second place, plural rod-shaped rotating members around which the belt member is stretched and rotated, an adjusting member that adjusts a position of the belt member, an initializing mechanism that performs an initialization processing of returning the inclination of the adjusting member to an initial state, and a controller that starts the initialization processing by the initializing mechanism.

2 Claims, 10 Drawing Sheets

IMAGE FORMING APPARATUS WITH INITIALIZATION MECHANISM

CROSS-REFERENCE TO RELATED APPLICATIONS

This application is based on and claims priority under 35 USC 119 from Japanese Patent Application No. 2013-171215 filed Aug. 21, 2013.

BACKGROUND (i) Technical Field

The present invention relates to an image forming apparatus.

(ii) Related Art

In the related art, image forming apparatuses that control meandering of an intermediate transfer belt with a steering roll are known.

SUMMARY

According to an aspect of the invention, there is provided an image forming apparatus including:

plural image holding members that have toner images formed on respective surfaces thereof and hold the toner images;

image forming sections that form the toner images on the plural image holding members, respectively;

a belt member that has an endless belt shape and moves along circulation paths that go via the plural image holding members, respectively;

plural transfer members each of which nips the belt member between the transfer member and a corresponding image holding member among the plural image holding members and transfers the toner image on the image holding member onto the belt member;

a moving mechanism that individually moves the plural transfer members between a first place where the belt member is nipped between the transfer member and the image holding member and a second place where the nipping of the belt member is released;

plural rod-shaped rotating members around which the belt member is stretched and rotated;

an adjusting member that adjusts a position of the belt member in a direction intersecting a movement direction of the belt member as the inclination of the adjusting member with respect to other rotating members included in the plural rotating members changes;

an initializing mechanism that performs an initialization processing of returning the inclination of the adjusting member to an initial state; and a controller that starts the initialization processing by the initializing mechanism after the movement of the transfer member by the moving mechanism is completed when the initializing mechanism performs the initialization processing and the moving mechanism moves the transfer member located further forward in the movement direction of the belt member than the transfer member that is already present in the first place from the second place to the first place.

BRIEF DESCRIPTION OF THE DRAWINGS

Exemplary embodiments of the present invention will be described in detail based on the following figures, wherein.

DETAILED DESCRIPTION

An exemplary embodiment of the invention will be described below with reference to the drawings.

Figure 1:
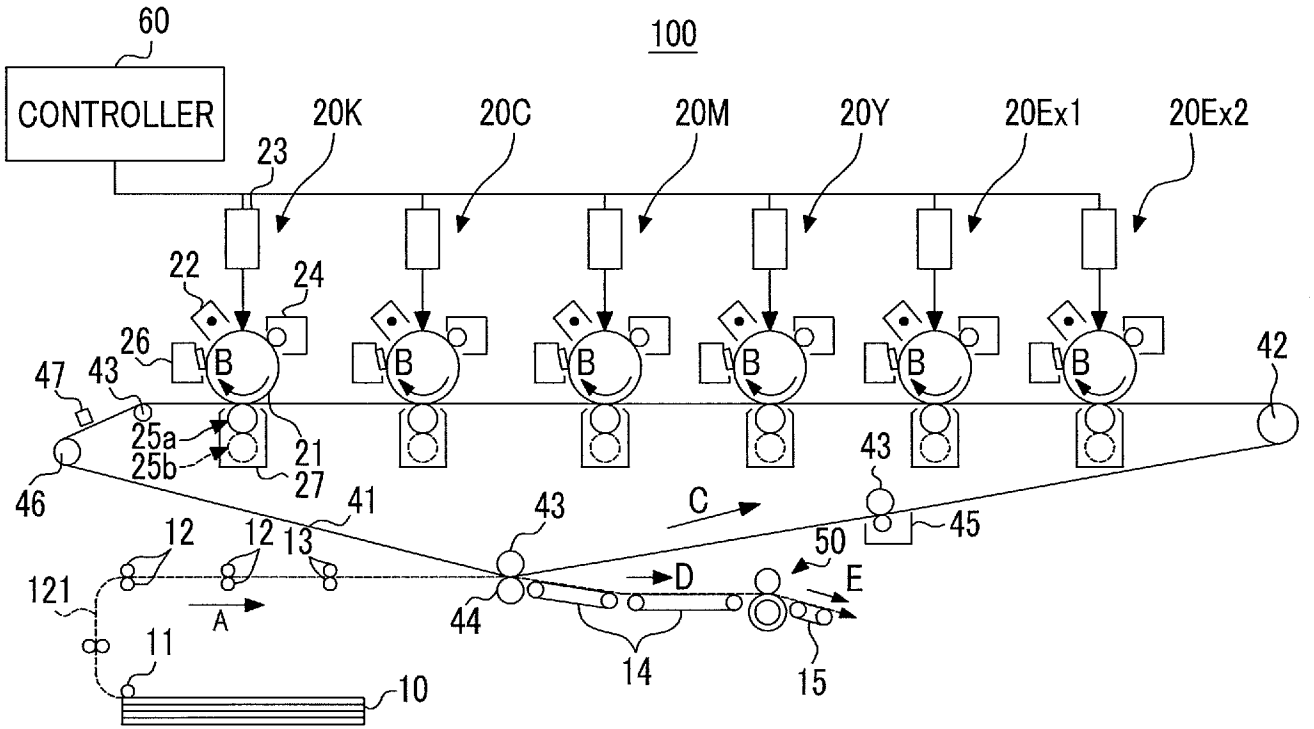
FIG. 1 is a schematic configuration view of a printer corresponding to an exemplary embodiment of an image forming apparatus.

FIG. 1 is a schematic configuration view of a printer corresponding to an exemplary embodiment of an image forming apparatus.

A printer 100 shown in FIG. 1 is a color printer that forms toner images by using respective toners in so-called process colors of a yellow (Y) color, a magenta (M) color, a cyan (C) color, and a black (K) color, and two extra colors (Ex1, Ex2) other than the process colors. As the extra colors, for example, an orange (O) color, a green (G) color, and a light magenta (Lm) color, a light cyan (Lc) color, and the like are common.

Additionally, the printer 100 is of a so-called tandem type in which six image forming engines 20Ex2, 20Ex1, 20Y, 20M, 20C and 20K that form toner images in respective YMCK colors and respective extra colors, are arranged along a transporting direction of a sheet.

The printer 100 includes a sheet feeding rack 10 at a lower portion thereof. Sheets are accommodated in the sheet feeding rack 10 in a stacked state.

In image formation, one sheet is delivered from the sheet feeding rack 10 by a pickup roll 11 and is transported in a direction of arrow A on a transporting path 121 by a transporting roll 12. Then, the sheet is further transported while the transporting timing after the above transportation is adjusted by a standby roll 13. The transportation after the standby roll 13 will be described below.

Additionally, as described above, the six image forming engines 20Ex2, 20Ex1, 20Y, 20M, 20C and 20K are arranged along the transporting direction of a sheet in the printer 100.

The image forming engines 20Ex2, 20Ex1, 20Y, 20M, 20C and 20K are engines that form toner images by using respective extra color toners, a Y color toner, an M color toner, a C color toner, and a K color toner, respectively. All of the six image forming engines 20Ex2, 20Ex1, 20Y, 20M, 20C and 20K have the same configuration except that toners to be used are different. Here, one image forming engine 20K will be taken as a representative of the six image forming engines 20Ex2, 20Ex1, and 20Y, 20M, 20C and 20K, and the configuration thereof will be described.

The image forming engine 20K has a photoconductor 21, and a charger 22, an exposure unit 23, a developer unit 24, a primary transfer roll 25, and a photoconductor cleaner 26 are arranged around the photoconductor 21. Here, the primary transfer roll 25 is arranged at a position where an intermediate transfer belt 41 to be described below is nipped between the primary transfer roll 25 and the photoconductor 21.

The photoconductor 21 has a cylindrical shape, and the surface of the photoconductor is charged, is exposed, and has an electrostatic latent image formed thereon while the photoconductor rotates in a direction of arrow B.

The charger 22 charges the rotating photoconductor 21.

Image data is input from a controller 60 to be described below to the exposure unit 23, and exposure light modulated according to the input image data is output from the exposure unit 23. The photoconductor 21 is irradiated with exposure light from the exposure unit 23 after being charged by the charger 22. As a result, an electrostatic latent image is formed on the surface of the photoconductor 21.

After the photoconductor 21 is irradiated with exposure light and has an electrostatic latent image formed on the surface thereof, the electrostatic latent image is developed by the developer unit 24 and a toner image is formed on the surface of the photoconductor 21.

The toner image formed on the photoconductor 21 by the development using the developer unit 24 is transferred onto the intermediate transfer belt 41 by the action of the primary transfer roll 25. Residual toner remaining on the surface of the photoconductor 21 after this transfer is removed from on the photoconductor 21 by the photoconductor cleaner 26.

Here, the primary transfer roll 25 is a member that is movable to a transfer position 25*a* and a standby position 25*b*, and the primary transfer roll 25 for each color is individually moved by a retract mechanism 27. In other words, the retract mechanism 27 moves the primary transfer roll 25 on a movement path that connects the transfer position 25*a* and the standby position 25*b*. Although description will be omitted regarding the specific structure of the retract mechanism 27, for example, a retract mechanism described in the JP-A-2010-139955 is adopted.

The printer 100 is provided with the controller 60, and image data showing a color image is input to the controller 60. The controller 60 generates image data for respective color toners that represent respective color image components when a color image is separated into respective YMCK colors and respective extra colors from this image data.

The controller 60 converts the image data for respective color toners into image data suitable for irradiation of the respective image forming engines 20Ex2, 20Ex1, 20Y, 20M, 20C, and 20K with exposure light in the exposure unit 23. The controller 60 transmits the image data after this conversion to each exposure unit 23, and the exposure unit 23 irradiates the photoconductor 21 with exposure light according to the input image data.

Additionally, the controller 60 also controls the movement of the primary transfer roll 25 by the retract mechanism 27. That is, the primary transfer roll 25 included in an image forming engine for a color to be used in a color mode is moved to the transfer position 25*a* according to the color mode selected by a user among various preset color modes, and the primary transfer roll 25 included in an image forming engine for a color that is not used in the color mode is moved to the standby position 25*b*.

Here, the description of the structure of the image forming engines will be temporarily interrupted, and color modes and the image forming engines to be used in the respective color modes will be described.

The following Table 1 shows the types of the color modes prepared for the printer 100 of the present exemplary embodiment, and the image forming engines to be used in the respective color modes.

TABLE 1

| | | Image Forming Engines | | | | | |
|---|---|---|---|---|---|---|---|
| | | Ex 2 | Ex 1 | Y | M | C | K |
| Color Modes | 6C | A | A | A | A | A | A |
| | 5C #1 | A | B | A | A | A | A |
| | 5C #2 | B | A | A | A | A | A |
| | 4C | B | B | A | A | A | A |
| | 2C | A | A | B | B | B | B |
| | 1C #2 | B | A | B | B | B | B |
| | 1C #1 | A | B | B | B | B | B |
| | 1C #6 | B | B | B | B | B | A |
| | 0C | B | B | B | B | B | B |

Respective rows of the table represent the respective color modes, and the respective columns of the table correspond to the respective image forming engines. Additionally, A marks in the table mean that corresponding image forming engines are used in the color modes thereof, and B marks mean that corresponding image forming engines are not used in the color modes thereof.

For example, a color mode "6C" is a mode that uses all six colors, and all the image forming engines are marked by A. Additionally, for example, a color mode "1C#1" is a mode where only the second extra color "Ex2" is used, only the image forming engine of "Ex2" is marked by A, and the other image forming engines are marked by B.

In the printer 100 of the present exemplary embodiment, a user selects a desired color mode from such various color modes. However, the user may not recognize a specific color mode as the specification of the color mode is automatically attached to image data, which is input to the printer 100 from the outside, by a device driver or the like.

The controller 60 of the printer 100 stores information corresponding to the above table, and moves the primary transfer roll 25 to the transfer position 25*a* or the standby position 25*b* as described above according to a selected color mode.

Hereinafter, a return is made to the interrupted description of the structure of the image forming engines.

The intermediate transfer belt 41 is an endless belt that is stretched around a driving roll 42, a steering roll 46, and plural other rolls 43, and circularly moves in a direction of arrow C. A circulation path along which the intermediate transfer belt 41 circularly moves is provided via the photoconductors 21 included in the six image forming engines 20Ex2, 20Ex1, 20Y, 20M, 20C, and 20K, respectively. Respective color toner images formed by the respective image forming engines 20Ex2, 20Ex1, 20Y, 20M, 20C, and 20K are transferred onto the intermediate transfer belt 41 by the primary transfer rolls 25 of the respective image forming engines. These toner images are transferred onto the intermediate transfer belt 41 so as to be sequentially superimposed on each other with a toner image formed by the image forming engine Ex2 for the second extra color being located as a lowermost layer. Then, a superimposed toner image formed by the respective color toner images being superimposed on each other is transported to a secondary transfer position where a secondary transfer roll 44 is arranged, with the movement of the intermediate transfer belt 41. In synchronization with this, as described above, the sheet transported up to the standby roll 13 is transported to the secondary transfer position, and the toner image on the intermediate transfer belt 41 is transferred onto the transported sheet by the action of the secondary transfer roll 44. The intermediate transfer belt 41 after the toner image is transferred onto the sheet by the secondary transfer roll 44 circularly moves further, and toner remaining on the surface of the intermediate transfer belt is removed from the intermediate transfer belt 41 by a belt cleaner 45.

The position of the intermediate transfer belt 41 in the depth direction of FIG. 1 fluctuates with the circular movement due to a fact that the mutual strict parallelism in the driving roll 42, the steering roll 46, and the plural other rolls 43 may not be realized. Therefore, in the present exemplary embodiment, the position of the intermediate transfer belt 41 is detected by an edge sensor 47, the inclination of the steering roll 46 is adjusted on the basis of the detected position as will be described below in detail, and thereby, stabilization (positional adjustment) of the position of the intermediate transfer belt 41 in the depth direction of FIG. 1 is achieved.

The sheet to which the toner image is transferred by the action of the secondary transfer roll 44 is transported in a direction of arrow D on a transporting belt 14, and the toner image on the sheet is fixed on the sheet by pressurization and heating using a fixing unit 50. As a result, an image including the fixed toner image is formed on the sheet. The sheet on which the image is formed is transported in a direction of arrow E by a transporting belt 15 and is ejected to the outside of the printer 100.

The photoconductors 21 included in the above-described image forming engines 20Ex2, 20Ex1, 20Y, 20M, 20C, and 20K for respective colors, respectively, in such a printer 100 correspond to an example of plural image holding members in the invention. Additionally, combining the charger 22, the exposure unit 23, and the developer unit 24 included in each of the image forming engines 20Ex2, 20Ex1, 20Y, 20M, 20C, and 20K for respective colors corresponds to an example of an image forming section in the invention. The above-described intermediate transfer belt 41 corresponds to an example of a belt member in the invention, the six primary transfer rolls 25 correspond to an example of plural transfer members in the invention, and the retract mechanism 27 corresponds to an example of plural moving mechanisms in the invention. Additionally, combining the driving roll 42, the steering roll 46, and the plural other rolls 43 corresponds to an example of plural rotating members in the invention, and the steering roll 46 corresponds to an example of an adjusting member in the invention.

Next, the positional adjustment of the intermediate transfer belt 41 by the steering roll 46 will be described in detail.

As described above, in the printer 100 of the present exemplary embodiment, the positional adjustment of the intermediate transfer belt 41 is performed by the inclination adjustment of the steering roll 46. Also, the printer 100 is provided with an adjusting mechanism that actively adjusts the inclination of the steering roll 46.

Figure 2:
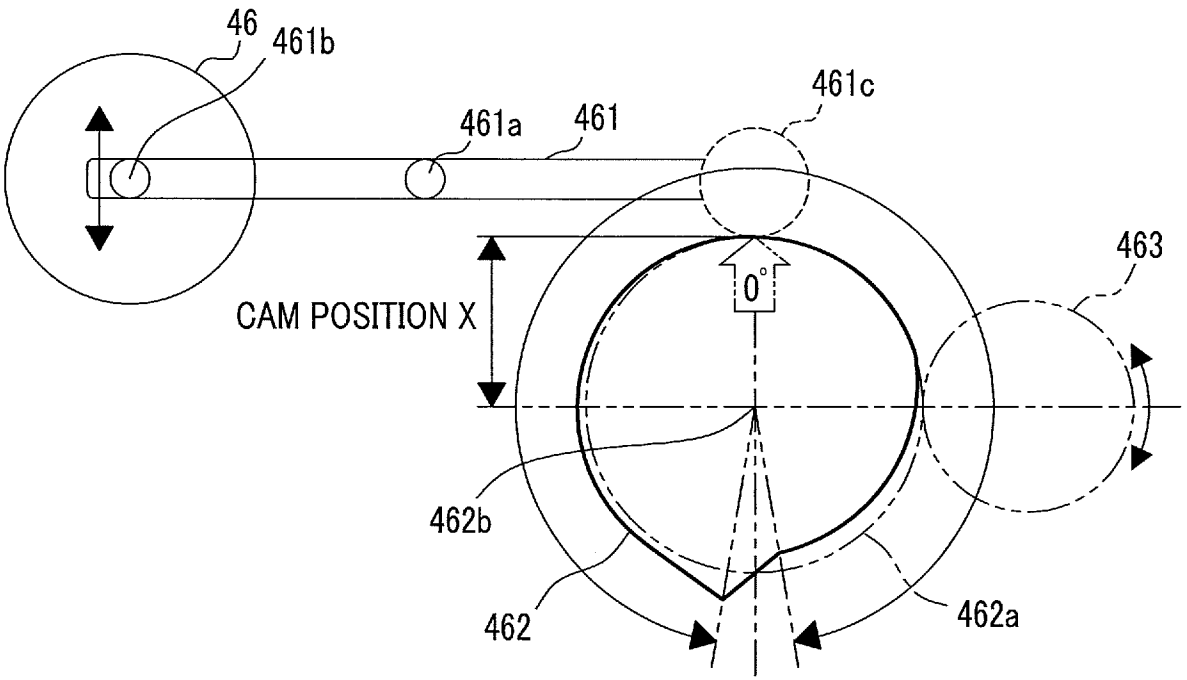
FIG. 2 is a view showing an adjusting mechanism that adjusts the inclination of a steering roll.

FIG. 2 is a view showing the adjusting mechanism that adjusts the inclination of the steering roll.

A steering arm 461, a cam 462, and a driving gear 463 are provided as an inclination adjusting mechanism of the steering roll 46 in the printer 100.

The steering arm 461 has an intermediate portion rotatably supported by a supporting shaft 461*a*. Additionally, one end of the steering roll 46 is rotatably connected to a first end 461*b* of the steering arm 461, and a second end 461*c* of the steering arm 461 is strongly pressed against the cam 462.

The cam 462 rotates around a rotation center 462*b* integrally with a cam gear 462*a*, and the cam gear 462*a* meshes with the driving gear 463 and is driven by the driving gear 463. The driving gear 463 is fixed to a rotating shaft of a stepping motor whose illustration is omitted, and this step motor varies in rotation angle stepwise according to an instruction from the above-described controller 60.

A state where the angle of the cam 462 is zero and a "cam position" is also zero is shown in FIG. 2. Here, the "cam position" means the height of a cam surface in a place where the cam 462 contacts the second end 461*c* of the steering arm 461.

When the driving gear 463 is rotated in the clockwise direction by the driving of the stepping motor, the cam 462 rotates in the counterclockwise direction and the cam position descends in a downward direction of FIG. 2. Thus, the steering roll 46 ascends in an upward direction of FIG. 2. The rotation of the cam 462 in a direction in which the cam position descends in this way is referred to as minus-direction rotation. On the contrary, when the driving gear 463 is rotated in the counterclockwise direction, the cam 462 rotates in the clockwise direction and the cam position ascends in the upward direction of FIG. 2. Thus, the steering roll 46 descends in the downward direction of FIG. 2. The rotation of the cam 462 in a direction in which the cam position ascends in this way is referred to as a plus-direction rotation.

Figure 3A:
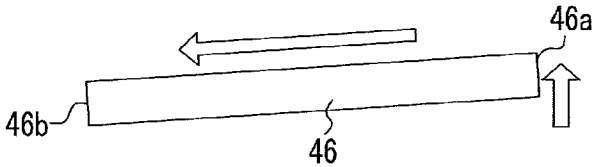
FIGS. 3A and 3B are explanatory views showing an aspect where an intermediate transfer belt is positionally adjusted to a back side of FIG. 1.
Figure 3B:
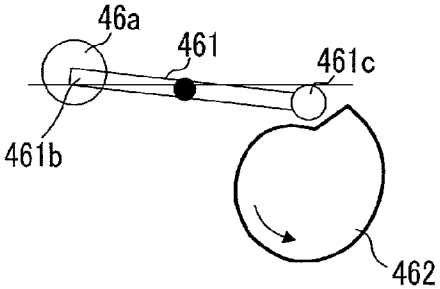
Figure 4A:
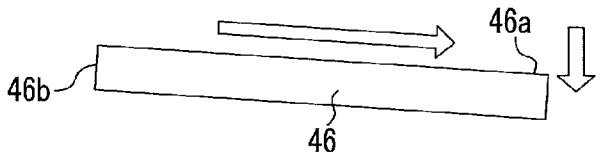
FIGS. 4A and 4B are explanatory views showing an aspect where the intermediate transfer belt is positionally adjusted to a near side of FIG. 1.
Figure 4B:
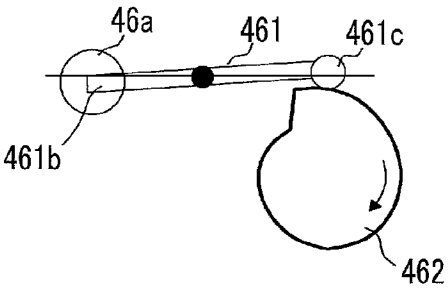

FIGS. 3A to 4B are explanatory views of an aspect where the intermediate transfer belt is positionally adjusted. An aspect where the intermediate transfer belt is positionally adjusted to the back side of FIG. 1 is shown in FIGS. 3A and 3B, and an aspect where the intermediate transfer belt is positionally adjusted to the near side of FIG. 1 is shown in FIGS. 4A and 4B.

Front views (that is, views as seen from the left of FIG. 1) of the steering roll 46 are shown in FIGS. 3A and 4A, respectively, and front view (that is, views as seen from the front of FIG. 1) of the steering arm 461 are shown in FIGS. 3B and 4B, respectively.

The steering roll 46 includes a first end 46*a* movable by the steering arm 461 and has a second end 46*b* supported in a pivoted (fixed) cantilevered manner.

When the cam 462 rotates in the minus direction as shown in FIGS. 3A and 3B from a state where the angle of the cam 462 shown in FIG. 2 is zero, the second end 461*c* of the steering arm 461 descends and the first end 461*b* ascends. Thus, the first end 46*a* of the steering roll 46 moves upward, and the inclination angle of the steering roll 46 changes by an angle according to the rotational amount (that is, the number of rotation steps of the stepping motor) of the cam 462. Then, when the first end 46*a* of the steering roll 46 moves upward, the intermediate transfer belt 41 (whose illustration is omitted in FIGS. 3A to 4B) moves to the second end 46*b* side of the steering roll 46.

On the contrary, when the cam 462 rotates in the plus direction as shown in FIGS. 4A and 4B from a state where the angle of the cam 462 shown in FIG. 2 is zero, the second end 461*c* of the steering arm 461 ascends and the first end 461*b* descends. Thus, the first end 46*a* of the steering roll 46 moves downward, and the inclination angle of the steering roll 46 changes by an angle according to the rotational amount (that is, the number of rotation steps of the stepping motor) of the cam 462, to the side opposite to the inclination shown in FIGS. 3A and 3B. Then, when the first end 46*a* of the steering roll 46 moves downward, the intermediate transfer belt 41 (whose illustration is omitted in FIGS. 3A to 4B) moves to the first end 46*a* side of the steering roll 46.

The adjustment amount of the position of the intermediate transfer belt 41 is calculated by the controller 60 on the basis of the position detection using the above-described edge sensor 47, and the position of the intermediate transfer belt 41 is adjusted by the number of steps according to the calculated adjustment amount being instructed to the stepping motor that drives the driving gear 463 from the controller 60.

Incidentally, since it is not known which degree the angle (that is, the inclination of the steering roll) of the cam 462 is immediately after a power source is turned on from a state where the printer 100 is turned off, initialization for returning the angle of the cam 462 to the angle zero shown in FIG. 2 and returning the inclination of the steering roll horizontally is required. In addition, although the inclination of the steering roll realized by the initialization is not limited to horizontal when the inclination of a predetermined reference is provided, the horizontal is adopted herein as a preferable example.

Figure 5A:
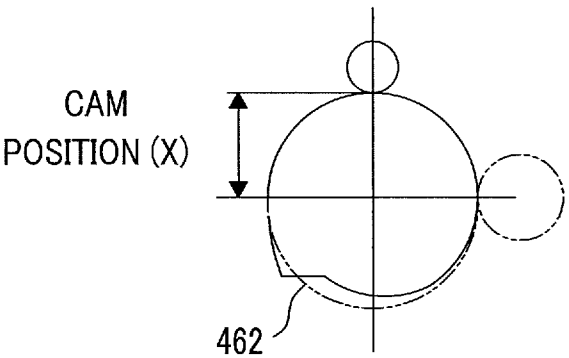
FIGS. 5A to 5C are views showing a procedure of initialization.
Figure 5B:
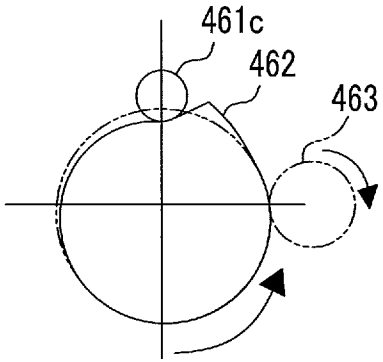
Figure 5C:
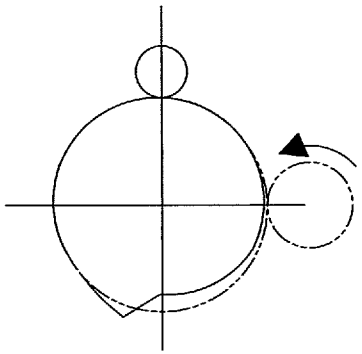

FIGS. 5A to 5C are views showing a procedure of the initialization.

Immediately after power activation, as shown in FIG. 5A, the angle of the cam 462 is unknown and the cam position is also unknown. From this state, as shown in FIG. 5B, the driving gear 463 is rotated in the clockwise direction to rotate the cam 462 in the minus direction. Then, as the second end 461*c* of the steering arm 461 bumps against a step of the cam 462, the rotation of the cam 462 stops and the stepping motor that drives the driving gear 463 also stops. Thereafter, as shown in FIG. 5C, the driving gear 463 rotates in the counterclockwise direction to such a degree that the cam 462 returns to the angle zero in plus direction.

According to the procedure described above, the cam 462 is initialized to the angle zero, and the inclination of the steering roll is initialized to the horizontal. Accordingly, combining the steering arm 461, the cam 462, and the driving gear 463 corresponds to an example of an initializing mechanism in the invention.

The intermediate transfer belt 41 undergoes states as described below during the above-described initialization.

Figure 6C:
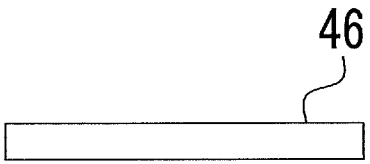
FIGS. 6A to 6C are front views of the steering roll showing the state changes of the intermediate transfer belt during the initialization of the steering roll.
Figure 6B:
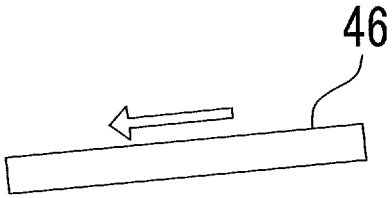
Figure 6A:
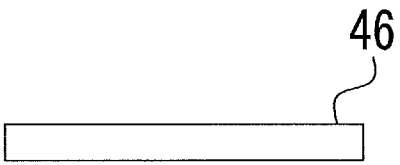
Figure 7A:
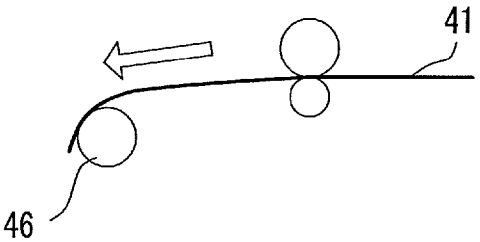
FIGS. 7A to 7C are side views of the intermediate transfer belt showing the state changes of the intermediate transfer belt during the initialization of the steering roll.
Figure 7B:
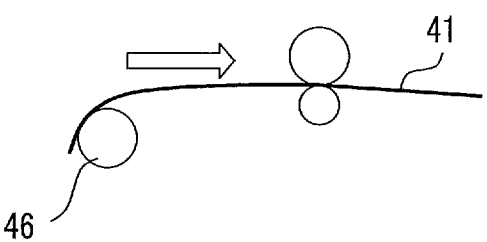
Figure 7C:
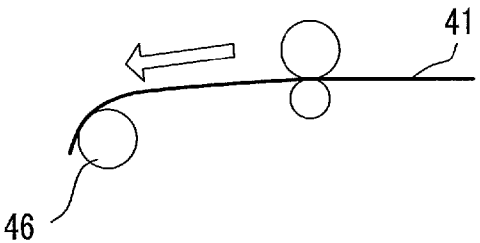

FIGS. 6A to 7C are views showing the state changes of the intermediate transfer belt during the initialization of the steering roll. Front views (that is, views as seen from the left of FIG. 1) of the steering roll are shown in FIGS. 6A to 6C, and side views (that is, views as seen from the front of FIG. 1) of the intermediate transfer belt are shown in FIGS. 7A to 7C.

States corresponding to FIGS. 5A to 5C are shown in FIGS. 6A to 6C and FIGS. 7A to 7C, respectively. That is, states when the initialization is started are shown in FIGS. 6A and 7A, respectively, states when the cam has rotated to the maximum in the minus direction are shown in FIGS. 6B and 7B, respectively, and initial states when the cam has returned to the angle zero are shown in FIGS. 6C and 7C, respectively.

When the initialization of the steering roll is started, the direction and amount of the inclination of the steering roll 46 are unknown as shown in FIG. 6A, and the intermediate transfer belt 41 is brought into a state where the intermediate transfer belt is pulled to the steering roll 46 side as shown in FIG. 7A.

When the cam has rotated to the maximum in the minus direction, as shown in FIG. 6B, the steering roll 46 inclines to the maximum to the left in the drawing and the intermediate transfer belt is brought into a state where the intermediate transfer belt is biased toward the left in the drawing with respect to the steering roll 46. As a result, as shown in FIG. 7B, the intermediate transfer belt 41 is brought into a state where the tension thereof to the steering roll 46 side becomes weaker and more saggy.

Thereafter, in the initial state, as shown in FIG. 6C, the steering roll 46 becomes horizontal, and the bias of the intermediate transfer belt with respect to the steering roll 46 is also eliminated. As a result, as shown in FIG. 7C, the intermediate transfer belt 41 is brought into a state where the intermediate transfer belt is pulled to the steering roll 46 side again.

In this way, the states of the intermediate transfer belt 41 change during the initialization of the steering roll 46.

Incidentally, a certain amount of execution time is required for such initialization, and a certain amount of execution time is required even when the above-described color modes are changed and the primary transfer roll 25 is moved. Also, image formation is on standby until those execution times pass. For example, there is a case where both of the initialization of the steering roll 46 and the movement of the primary transfer roll 25 are required, for example, immediately after the power activation, at the time of return from a sleep state, or the like. Also, it is desirable from a viewpoint of convenience that the standby time be suppressed. When the primary transfer roll 25 is moved simultaneously with the initialization, the execution times and the standby time are suppressed, which is preferable. However, a situation where the initialization of the steering roll and the movement of the primary transfer roll should not be executed simultaneously is considered, and ability to cope with such a situation is planned in the printer 100 of the present exemplary embodiment.

First, an exceptional situation where the initialization of the steering roll and the movement of the primary transfer roll should not be simultaneously executed will be described.

Figure 8:
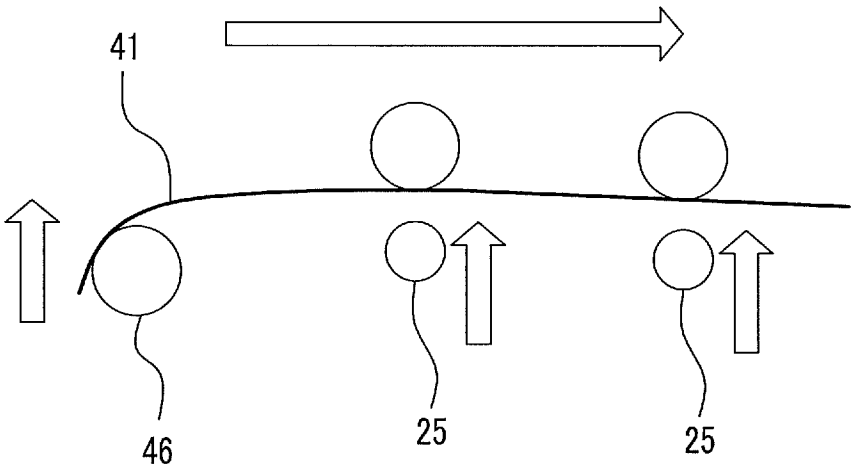
FIG. 8 is a view showing an aspect in an initiation stage of the initialization when the initialization of the steering roll and the movement of a primary transfer roll are simultaneously executed.
Figure 9:
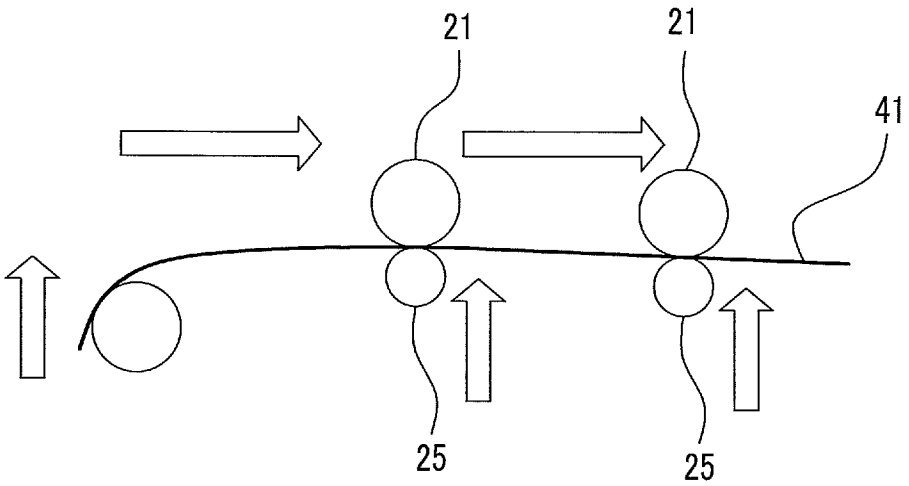
FIG. 9 is a view showing an aspect in a halfway stage of the initialization when the initialization of the steering roll and the movement of the primary transfer roll are simultaneously executed.
Figure 10:
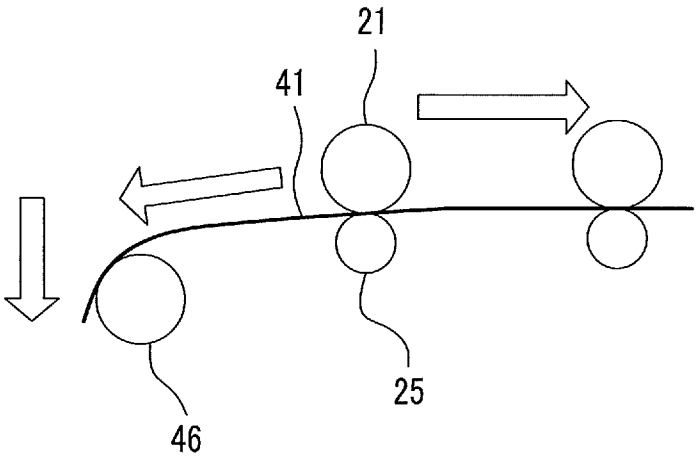
FIG. 10 is a view showing an aspect in a termination stage of the initialization when the initialization of the steering roll and the movement of the primary transfer roll are simultaneously executed.

FIGS. 8 to 10 are explanatory views of the situation where the initialization of the steering roll and the movement of the primary transfer roll should not be simultaneously executed. An aspect in an initiation stage of the initialization is shown in FIG. 8, an aspect in a halfway stage of the initialization is shown in FIG. 9, and an aspect in a termination stage of the initialization is shown in FIG. 10.

When the initialization of the steering roll is started, as shown in FIG. 8, (one end of) the steering roll 46 ascends upward in the drawing, and the intermediate transfer belt 41 sags. At this time, although the primary transfer roll 25 starts its movement from the standby position apart from the intermediate transfer belt 41 to the transfer position where the primary transfer roll contacts the intermediate transfer belt 41, the primary transfer roll has not yet reached the transfer position, and the sagging of the intermediate transfer belt 41 reaches the backside (the side opposite to the steering roll 46 across the primary transfer roll 25) of the primary transfer roll 25 during movement.

Thereafter, when the primary transfer roll 25 reaches the transfer position, as shown in FIG. 9, the intermediate transfer belt 41 that remains sagging is nipped between the primary transfer roll 25 and the photoconductor 21.

Then, at the time of termination of the initialization, as shown in FIG. 10, the intermediate transfer belt 41 is pulled as the steering roll 46 descends, but sagging remains on the backside from a place nipped between the primary transfer roll 25 and the photoconductor 21. When the initialization of the steering roll and the movement of the primary transfer roll are simultaneously executed in this way, it is considered that the sagging remains partially in the intermediate transfer belt 41. When image formation is executed in a state where the sagging remains in the intermediate transfer belt 41 in this way, there is a possibility that the intermediate transfer belt 41 may be creased.

Since such a situation is not a situation that necessarily occurs when the initialization and the movement of the primary transfer roll are simultaneously executed, and cases where there is a possibility that the above situation may not occur even when the initialization and the movement are simultaneously executed are many, occurrence of the situation shown in FIGS. 8 to 10 is avoided in the printer 100 of the present exemplary embodiment by the control to be described below.

Figure 11:
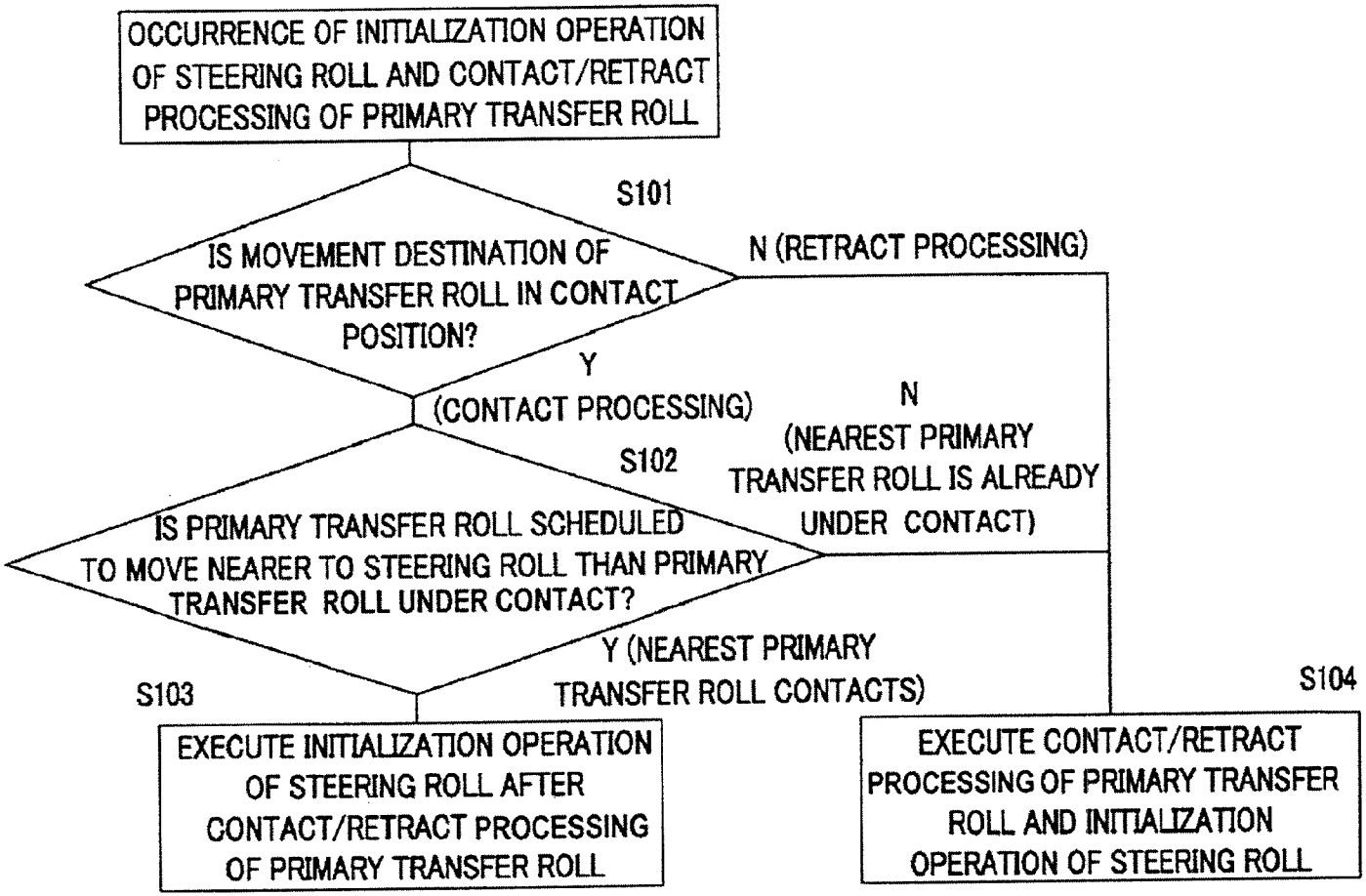
FIG. 11 is a flowchart showing the control processing of controlling the simultaneous execution of the initialization and the movement of the primary transfer roll.

FIG. 11 is a flowchart showing the control processing of controlling the simultaneous execution of the initialization and the movement of the primary transfer roll.

When both of the initialization operation of the steering roll and the movement of the primary transfer roll by a color mode change are required, the control processing of this flowchart is started.

In Step S101, first, it is confirmed whether a movement destination of a primary transfer roll for which the present movement is required is the transfer position where the primary transfer roll contacts the intermediate transfer belt or is the standby position spaced apart (retracted) from the intermediate transfer belt. In this confirmation, when movement destinations of all the primary transfer rolls to move are the standby positions (Step S101; N), the situation shown in FIGS. 8 to 10 does not occur. Thus, the processing proceeds to Step S104 where the initialization operation of the steering roll and the movement of the primary transfer roll are simultaneously executed. This case corresponds to, for example, changes from the color mode "6C" to other color modes, a change from the color mode "2C" to the color mode "1C#1", or the like, when being applied to the above Table 1.

In the confirmation in Step S101, when a primary transfer roll to move to the transfer position is present (Step S101; Y), the processing proceeds to Step S102 where the positional relationship between the primary transfer roll scheduled to move to the transfer position and other primary transfer rolls is confirmed. That is, it is confirmed whether or not the primary transfer roll scheduled to move is located ahead of a primary transfer roll that is already at the transfer position (on the front side in the movement direction of the intermediate transfer belt; a direction directed to the steering roll). As a result, when the primary transfer roll that is already at the transfer position is located ahead of the primary transfer roll scheduled to move (Step S102; N), the situation shown in FIGS. 8 to 10 does not occur. Thus, the processing proceeds to Step S104 where the initialization operation of the steering roll and the movement of the primary transfer roll are simultaneously executed. This case corresponds to, for example, changes from the color mode "4C" to the color mode "6C", a change from the color mode "1C#6" to the color mode "4C", or the like, when being applied to the above Table 1.

In the confirmation in Step S102, when the primary transfer roll scheduled to move to the transfer position is located ahead of the primary transfer roll that is already at the transfer position, the situation shown in FIGS. 8 to 10 may occur. Thus, the processing proceeds to Step S103 where the movement processing of the primary transfer rolls is first executed, and the initialization operation of the steering roll is then executed. This case corresponds to, for example, a change from the color mode "2C" to the color mode "4C" and "6C", a change from the color mode "1C#1" to the color mode "2C", or the like, when being applied to the above Table 1.

The controller 60 that executes such control processing corresponds to an example of a controller in the invention.

In addition, although the printer is illustrated as one exemplary embodiment of the image forming apparatus of the invention in the above description, the image forming apparatus of the invention may be a copy machine, a facsimile, and a multi-function machine.

Additionally, although the example including the six photoconductors 21 having the same size is shown in the above description, the plural image holding members in the invention do not need to have the same size. For example, the image holding member for a K color may be larger than the image holding members for the other colors.

Additionally, although the six photoconductors 21 are illustrated as the plural image holding members in the above description, the plural image holding members in the invention may be five and four image holding members. For example, color modes described in the following Table 2 are considered as color modes in the case where the five image holding members are included.

TABLE 2

| | | Image Forming Engines | | | | |
|---|---|---|---|---|---|---|
| | | Ex | Y | M | C | K |
| Color Modes | 5C | A | A | A | A | A |
| | 4C | B | A | A | A | A |
| | 2C | A | B | B | B | A |
| | 1C | A | B | B | B | B |
| | 1C | B | B | B | B | A |

Regarding the color modes described in this Table 2, when a case where the processing proceeds from Step S101 to Step S104 in FIG. 11 is applied, this case corresponds to, for example, changes from the color mode "5C" to other color modes, a change from the color mode "2C" to the color mode "1C", or the like. Additionally, when a case where the processing proceeds from Step S102 to Step S104 is applied, this case corresponds to, for example, a change from the color mode "2C" to the color mode "5C", a change from the color mode "1C" (the lowest row) to the color mode "2C" or the like. Additionally, when a case where the processing proceed from Step S102 to Step S103 is applied, this case corresponds to, for example, a change from the color mode "10" (the second row from the bottom) to the color mode "2C" or "4C", or the like.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a plurality of image holding members that have toner images formed on respective surfaces thereof and hold the toner images;

image forming sections that form the toner images on the plurality of image holding members, respectively;

a belt member that has an endless belt shape and moves along a circulation path that goes past the plurality of image holding members, respectively;

a plurality of transfer members each of which nips the belt member between the transfer member and a corresponding image holding member among the plurality of image holding members and transfers the toner image on the image holding member onto the belt member;

a moving mechanism that individually moves the plurality of transfer members between a first position where the belt member is nipped between the transfer member and the image holding member and a second position where the nipping of the belt member is released;

a plurality of rod-shaped rotating members around which the belt member is stretched and rotated;

an adjusting member that adjusts a position of the belt member in a direction intersecting a movement direction of the belt member as the inclination of the adjusting member changes with respect to other rotating members included in the plurality of rotating members;

an initializing mechanism that performs an initialization processing of returning the inclination of the adjusting member to an initial state; and a controller that starts the initialization processing by the initializing mechanism after the movement of the transfer member by the moving mechanism is completed when the initializing mechanism performs the initialization processing and the moving mechanism moves a first transfer member from the second position to the first position, wherein the first transfer member is located forward, in the movement direction of the belt member, of another transfer member that is already present in the first position.

2. The image forming apparatus according to claim 1, wherein the inclination of the adjusting member realized by the initialization processing is horizontal.

* * * * *